US009810106B2

(12) United States Patent
Fischer et al.

(10) Patent No.: US 9,810,106 B2
(45) Date of Patent: Nov. 7, 2017

(54) CAMSHAFT PHASER

(71) Applicant: DELPHI TECHNOLOGIES, INC., Troy, MI (US)

(72) Inventors: Thomas H. Fischer, Rochester, NY (US); Thomas H. Lichti, Victor, NY (US); Cai P. Shum, Mendon, NY (US); Jeremy N. Graves, Henrietta, NY (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 270 days.

(21) Appl. No.: 14/629,591

(22) Filed: Feb. 24, 2015

(65) Prior Publication Data

US 2015/0260060 A1 Sep. 17, 2015

Related U.S. Application Data

(60) Provisional application No. 61/952,279, filed on Mar. 13, 2014, provisional application No. 62/013,064, filed on Jun. 17, 2014.

(51) Int. Cl.
*F01L 1/24* (2006.01)
*F01L 1/344* (2006.01)

(52) U.S. Cl.
CPC ... *F01L 1/3442* (2013.01); *F01L 2001/34423* (2013.01); *F01L 2001/34426* (2013.01); *F01L 2001/34456* (2013.01)

(58) Field of Classification Search
CPC ..... F01L 1/3442; F01L 2001/34423; F01L 2001/34426; F01L 2001/34456; F01L 2001/34446; F01L 2001/3443; F01L 2001/34433
USPC ... 123/90.15, 90.12, 90.13, 90.17, 347, 348, 123/464; 464/1, 160
See application file for complete search history.

(56) References Cited

U.S. PATENT DOCUMENTS

| | | | |
|---|---|---|---|
| 5,172,659 | A | 12/1992 | Butterfield et al. |
| 5,343,834 | A | 9/1994 | Rembold et al. |
| 6,263,846 | B1 | 7/2001 | Simpson et al. |
| 6,311,655 | B1 | 11/2001 | Simpson et al. |
| 6,666,181 | B2 | 12/2003 | Smith et al. |
| 7,363,897 | B2 | 4/2008 | Fischer et al. |
| 8,056,519 | B2 | 11/2011 | Cuatt et al. |
| 8,127,728 | B2 | 3/2012 | Fischer et al. |

(Continued)

FOREIGN PATENT DOCUMENTS

WO WO 2014173398 A1 * 10/2014 ..... F01L 1/3442

*Primary Examiner* — Mark Laurenzi
*Assistant Examiner* — Paul Thiede
(74) *Attorney, Agent, or Firm* — Joshua M. Haines

(57) ABSTRACT

A camshaft phaser includes a stator having a plurality of lobes and a rotor coaxially disposed within the stator and having a plurality of vanes interspersed with the lobes defining a plurality of alternating advance chambers and retard chambers such that a phasing valve supplies and vents oil to and from the advance and retard chambers. A first check valve allows oil to flow from only one of the retard chambers to only one of the advance chambers when a first diverter valve permits communication between the one of the advance chambers and the first check valve and a second check valve allows oil to flow from the one of the advance chambers to the one of the retard chambers when a second diverter valve permits communication between the one of the retard chambers and the second check valve.

17 Claims, 11 Drawing Sheets

(56) References Cited

U.S. PATENT DOCUMENTS

| | | | | |
|---|---|---|---|---|
| 2008/0257288 | A1 | 10/2008 | Takahashi et al. | |
| 2009/0133651 | A1 | 5/2009 | Takenaka | |
| 2012/0255509 | A1 | 10/2012 | Lichti et al. | |
| 2014/0123920 | A1 | 5/2014 | Lichti et al. | |
| 2016/0069227 | A1* | 3/2016 | Raecklebe ..... | F01L 1/3442<br>123/90.15 |

* cited by examiner

CAMSHAFT PHASER

CROSS-REFERENCE TO RELATED PATENT APPLICATIONS

This patent application claims the benefit of U.S. Provisional Patent Application Ser. No. 61/952,279 filed on Mar. 13, 2014 and U.S. Provisional Patent Application Ser. No. 62/013,064 filed on Jun. 17, 2014, the disclosures of which are hereby incorporated by reference in their entirety.

TECHNICAL FIELD OF INVENTION

The present invention relates to a hydraulically actuated camshaft phaser for varying the phase relationship between a crankshaft and a camshaft in an internal combustion engine; more particularly to such a camshaft phaser that is a vane-type camshaft phaser; even more particularly to a vane-type camshaft phaser which includes a hydraulic circuit to return the camshaft phaser to a predetermined aligned position.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers by a phasing oil control valve in order to rotate the rotor within the stator and thereby change the phase relationship between an engine camshaft and an engine crankshaft. Camshaft phasers also commonly include an intermediate lock pin which selectively prevents relative rotation between the rotor and the stator at a predetermined aligned position that is intermediate of a full advance and a full retard position. The intermediate lock pin is engaged and disengaged by venting oil from the intermediate lock pin and supplying pressurized oil to the intermediate lock pin respectively by a lock pin oil control valve.

Upon failure of the phasing oil control valve, it may be desirable to use the intermediate lock pin to lock the camshaft phaser at the predetermined aligned position because the predetermined aligned position may provide valve timing which allows the internal combustion engine to start and run under all conditions. Prior art camshaft phasers commonly employ a bias spring to assist in returning the camshaft phaser to the predetermined aligned position if the phasing oil control valve fails. Examples of such a bias spring are shown in U.S. Pat. No. 7,363,897 to Fischer et al. and U.S. Pat. No. 8,127,728 also to Fischer et al. While bias springs may be effective, it may be desirable to provide another arrangement in addition to or in alternative to using a bias spring to ensure engagement of the intermediate lock pin with its corresponding seat.

What is needed is camshaft phaser which minimizes or eliminates one or more the shortcomings as set forth above.

SUMMARY OF THE INVENTION

Briefly described, a camshaft phaser is provided for controllably varying the phase relationship between a crankshaft and a camshaft in an internal combustion engine where the camshaft phaser includes a hydraulic circuit which aides in returning the camshaft phaser to a predetermined aligned position. The camshaft phaser includes a stator having a plurality of lobes and connectable to the crankshaft of the internal combustion engine to provide a fixed ratio of rotation between the stator and the crankshaft; a rotor coaxially disposed within the stator, the rotor having a plurality of vanes interspersed with the lobes defining a plurality of alternating advance chambers and retard chambers, wherein the advance chambers receive pressurized oil from a phasing oil control valve in order to change the phase relationship between the crankshaft and the camshaft in an advance direction and the retard chambers receive pressurized oil from the phasing oil control valve in order to change the phase relationship between the camshaft and the crankshaft in a retard direction, the rotor being rotatable within the stator from a full retard position to a full advance position and being attachable to the camshaft of the internal combustion engine to prevent relative rotation between the rotor and the camshaft; a lock pin disposed within one of the rotor and the stator for selective engagement with a lock pin seat for preventing a change in phase relationship between the rotor and the stator at a predetermined aligned position between the full advance position and the full retard position when the lock pin is engaged with the lock pin seat; a first diverter valve that is switchable between two positions of 1) blocking communication between the phasing oil control valve and only one of the advance chambers while permitting communication between the one of the advance chambers and a first check valve and of 2) permitting communication between the phasing oil control valve and the one of the advance chambers while blocking communication between the one of the advance chambers and the first check valve; and a second diverter valve that is switchable between two positions of 1) blocking communication between the phasing oil control valve and only one of the retard chambers while permitting communication between the one of the retard chambers and a second check valve and of 2) permitting communication between the phasing oil control valve and the one of the retard chambers while blocking communication between the one of the retard chambers and the second check valve. The first check valve allows oil to flow from the one of the retard chambers to the one of the advance chambers when the first diverter valve permits communication between the one of the advance chambers and the first check valve and the second check valve allows oil to flow from the one of the advance chambers to the one of the retard chambers when the second diverter valve permits communication between the one of the retard chambers and the second check valve.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
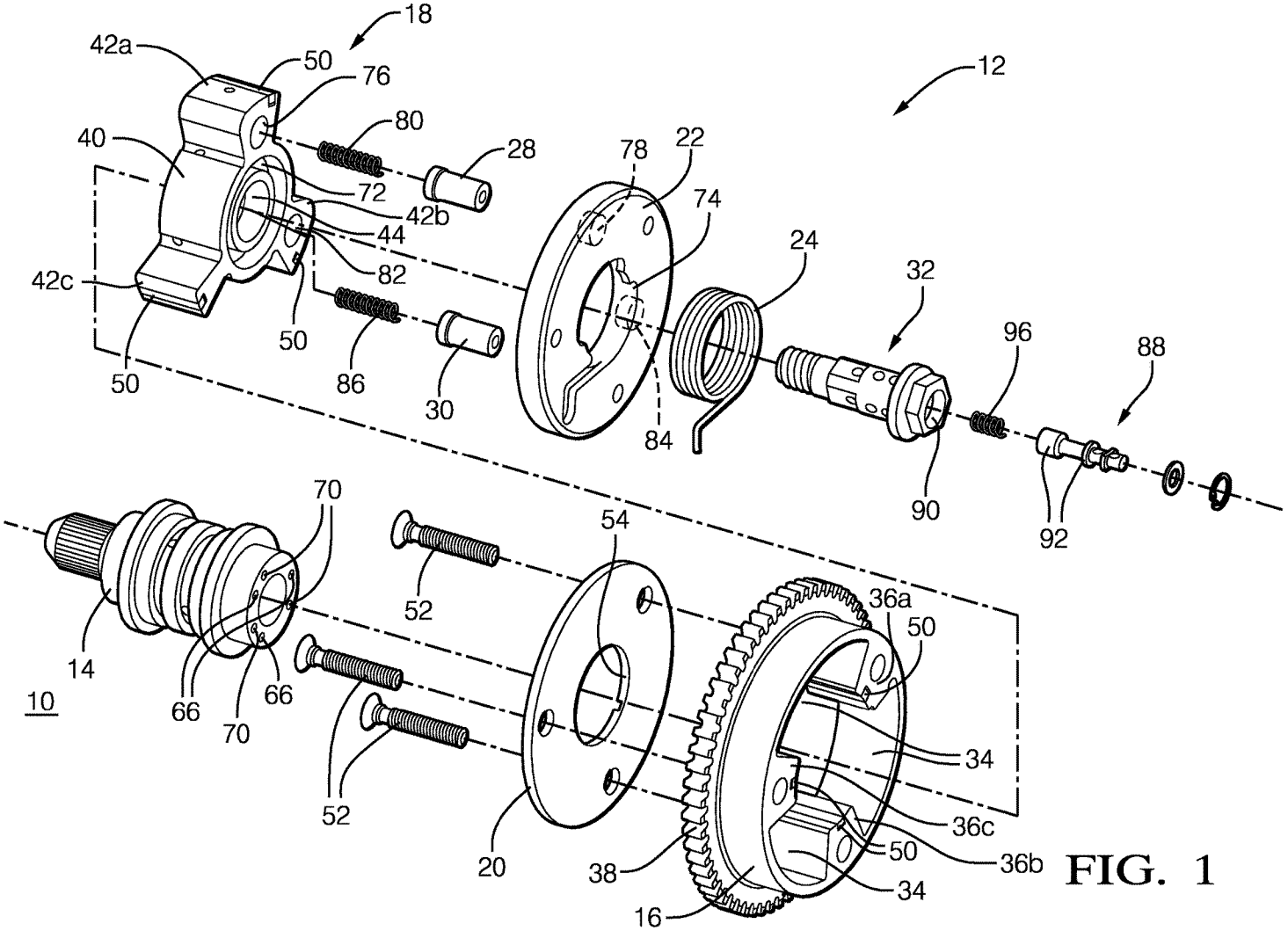
FIG. 1 is an exploded isometric view of a camshaft phaser in accordance with the present invention.

In accordance with a preferred embodiment of this invention and referring to FIGS. 1-4, an internal combustion engine 10 is shown which includes a camshaft phaser 12. Internal combustion engine 10 also includes a camshaft 14 which is rotatable about an axis A based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 16, a rotor 18 disposed coaxially within stator 16, a back cover 20 closing off one end of stator 16, a front cover 22 closing off the other end of stator 16, a bias spring 24 for urging rotor 18 in one direction relative to stator 16, a primary lock pin 28, a secondary lock pin 30, and a camshaft phaser attachment bolt 32 for attaching camshaft phaser 12 to camshaft 14. The various elements of camshaft phaser 12 will be described in greater detail in the paragraphs that follow.

Stator 16 is generally cylindrical and includes a plurality of radial chambers 34 defined by a plurality of lobes 36*a*, 36*b*, 36*c* extending radially inward. From this point forward, lobes 36*a*, 36*b*, 36*c* will be referred to generically as lobes 36 unless reference is being made to a specific lobe 36. In the embodiment shown, there are three lobes 36 defining three radial chambers 34, however, it is to be understood that a different number of lobes 36 may be provided to define radial chambers 34 equal in quantity to the number of lobes 36. Stator 16 may also include a sprocket 38 formed integrally therewith or otherwise fixed thereto. Sprocket 38 is configured to be driven by a chain or gear (not shown) that is driven by the crankshaft of internal combustion engine 10. Alternatively, sprocket 38 may be a pulley driven by a belt.

Rotor 18 includes a central hub 40 with a plurality of vanes 42*a*, 42*b*, 42*c* extending radially outward therefrom and a central through bore 44 extending axially therethrough. From this point forward, vanes 42*a*, 42*b*, 42*c* will be referred to generically as vanes 42 unless reference is being made to a specific vane 42. The number of vanes 42 is equal to the number of radial chambers 34 provided in stator 16. Rotor 18 is coaxially disposed within stator 16 such that each vane 42 divides each radial chamber 34 into advance chambers 46*a*, 46*b*, 46*c* and retard chambers 48*a*, 48*b*, 48*c*. From this point forward, advance chambers 46*a*, 46*b* 46*c* will be referred to generically as advance chambers 46 unless reference is being made to a specific advance chamber 46. Similarly, from this point forward, retard chambers 48*a*, 48*b*, 48*c* will be referred to generically as retard chambers 48 unless reference is being made to a specific retard chamber 48. The radial tips of lobes 36 are mateable with central hub 40 in order to separate radial chambers 34 from each other. Each of the radial tips of lobes 36 and vanes 42 may include one of a plurality of wiper seals 50 to substantially seal adjacent advance chambers 46 and retard chambers 48 from each other.

Back cover 20 is sealingly secured, using cover bolts 52, to the axial end of stator 16 that is proximal to camshaft 14. Tightening of cover bolts 52 prevents relative rotation between back cover 20 and stator 16. Back cover 20 includes a back cover central bore 54 extending coaxially therethrough. The end of camshaft 14 is received coaxially within back cover central bore 54 such that camshaft 14 is allowed to rotate relative to back cover 20. In an alternative arrangement, sprocket 38 may be integrally formed or otherwise attached to back cover 20 rather than stator 16.

Similarly, front cover 22 is sealingly secured, using cover bolts 52, to the axial end of stator 16 that is opposite back cover 20. Cover bolts 52 pass through back cover 20 and stator 16 and threadably engage front cover 22, thereby clamping stator 16 between back cover 20 and front cover 22 to prevent relative rotation between stator 16, back cover 20, and front cover 22. In this way, advance chambers 46 and retard chambers 48 are defined axially between back cover 20 and front cover 22.

Camshaft phaser 12 is attached to camshaft 14 with camshaft phaser attachment bolt 32 which extends coaxially through central through bore 44 of rotor 18 and threadably engages camshaft 14, thereby by clamping rotor 18 securely to camshaft 14. In this way, relative rotation between stator 16 and rotor 18 results in a change in phase or timing between the crankshaft of internal combustion engine 10 and camshaft 14.

Pressurized oil is selectively supplied to advance chambers 46 and vented from retard chambers 48 in order to cause relative rotation between stator 16 and rotor 18 which results in advancing the timing of camshaft 14 relative to the crankshaft of internal combustion engine 10. Conversely, oil is selectively supplied to retard chambers 48 and vented from advance chambers 46 in order to cause relative rotation between stator 16 and rotor 18 which results in retarding the timing of camshaft 14 relative to the crankshaft of internal combustion engine 10. Advance oil passages 56 may be provided in rotor 18 for supplying and venting oil to and from advance chambers 46 while retard oil passages 58 may be provided in rotor 18 for supplying and venting oil to and from retard chambers 48. Supplying and venting of oil to and from advance chambers 46 and retard chambers 48 may be controlled by a phasing oil control valve 60 located external to camshaft phaser 12, for example, within internal combustion engine 10. Phasing oil control valve 60 is shown in schematic form in FIGS. 3 and 4 and receives pressurized oil from an oil source 62, for example an oil pump used to lubricate various components of internal combustion engine 10. When it is desired to advance the timing of camshaft 14 relative to the crankshaft, phasing oil control valve 60 is operated to supply pressurized oil to advance chambers 46 while venting oil from retard chambers 48. Pressurized oil from phasing oil control valve 60 is supplied to advance chambers 46 through an annular camshaft advance oil passage 64 of camshaft 14, axial camshaft advance oil passages 66 of camshaft 14, and advance oil passages 56 of rotor 18. At the same time, oil is vented from retard chambers 48 through an annular camshaft retard oil passage 68 of camshaft 14, axial camshaft retard oil passages 70 of camshaft 14, and retard oil passages 58 of rotor 18. Conversely, when it is desired to retard the timing of camshaft 14 relative to the crankshaft, phasing oil control valve 60 is operated to supply pressurized oil to retard chambers 48 while venting oil from advance chambers 46. Pressurized oil from phasing oil control valve 60 is supplied to retard chambers 48 through annular camshaft retard oil passage 68 of camshaft 14, axial camshaft retard oil passages 70 of camshaft 14, and retard oil passages 58 of rotor 18. At the same time, oil is vented from advance chambers 46 through annular camshaft advance oil passage 64 of camshaft 14, axial camshaft advance oil passages 66 of camshaft 14, and advance oil passages 56 of rotor 18. When no change in timing is desired between camshaft 14 the crankshaft, phasing oil control valve 60 is operated to substantially equalize the pressure between advance chambers 46 and retard chambers 48. This may be accomplished by providing minimal fluid communication from phasing oil control valve 60 to advance chambers 46 and retard chambers 48 simultaneously. In this way, rotor 18 rotates within stator 16 between a maximum advance position and a maximum retard position as determined by the space available for vanes 42 to move within radial chambers 34. Alternatively, an oil control valve may be provided within camshaft phaser 12 to control the supply and venting of oil to and from advance chambers 46 and the supply and venting of oil to and from retard chambers 48 as is known in the art, for example as shown in United States Patent Application Publication No. US 2012/0255509 A1 to Lichti et al. which is incorporated herein by reference in its entirety.

Bias spring 24 is disposed within an annular pocket 72 formed in rotor 18 and within a central bore 74 of front cover 22. Bias spring 24 is grounded at one end thereof to front cover 22 and is attached at the other end thereof to rotor 18. In this way, bias spring 24 is used to either partially or completely offset the natural retarding torque induced by the overall valve train friction, balance performance times, or to help return the phaser to a predetermined aligned position of rotor 18 within stator 16 which is between the full advance and full retard positions. When internal combustion engine 10 is shut down or if there is a malfunction of phasing oil control valve 60, bias spring 24 helps to urge rotor 18 to the predetermined aligned position within stator 16 in a way that will be described in more detail in the subsequent paragraphs. While camshaft phaser 12 has been described as including bias spring 24, it should now be understood that bias spring 24 may be omitted.

Primary lock pin 28 and secondary lock pin 30 define a staged dual lock pin system for selectively preventing relative rotation between stator 16 and rotor 18 at the predetermined aligned position which is between the full retard and full advance positions. Primary lock pin 28 is slidably disposed within a primary lock pin bore 76 formed in vane 42*a* of rotor 18. A primary lock pin seat 78 is formed in front cover 22 for selectively receiving primary lock pin 28 therewithin. Primary lock pin seat 78 is larger than primary lock pin 28 to allow rotor 18 to rotate relative to stator 16 about 5° on each side of the predetermined aligned position when primary lock pin 28 is seated within primary lock pin seat 78. The enlarged nature of primary lock pin seat 78 allows primary lock pin 28 to be easily received therewithin. When primary lock pin 28 is not desired to be seated within primary lock pin seat 78, pressurized oil is supplied to primary lock pin 28, thereby urging primary lock pin 28 out of primary lock pin seat 78 and compressing a primary lock pin spring 80. Conversely, when primary lock pin 28 is desired to be seated within primary lock pin seat 78, the pressurized oil is vented from primary lock pin 28, thereby allowing primary lock pin spring 80 to urge primary lock pin 28 toward front cover 22. In this way, primary lock pin 28 is seated within primary lock pin seat 78 by primary lock pin spring 80 when rotor 18 is positioned within stator 16 to allow alignment of primary lock pin 28 with primary lock pin seat 78.

Secondary lock pin 30 is slidably disposed within a secondary lock pin bore 82 formed in vane 42*b* of rotor 18. A secondary lock pin seat 84 is formed in front cover 22 for selectively receiving secondary lock pin 30 therewithin. Secondary lock pin 30 fits within secondary lock pin seat 84 in a close sliding relationship, thereby substantially preventing relative rotation between rotor 18 and stator 16 when secondary lock pin 30 is received within secondary lock pin seat 84. When secondary lock pin 30 is not desired to be seated within secondary lock pin seat 84, pressurized oil is supplied to secondary lock pin 30, thereby urging secondary lock pin 30 out of secondary lock pin seat 84 and compressing a secondary lock pin spring 86. Conversely, when secondary lock pin 30 is desired to be seated within secondary lock pin seat 84, the pressurized oil is vented from secondary lock pin 30, thereby allowing secondary lock pin spring 86 to urge secondary lock pin 30 toward front cover 22. In this way, secondary lock pin 30 is seated within secondary lock pin seat 84 by secondary lock pin spring 86 when rotor 18 is positioned within stator 16 to allow alignment of secondary lock pin 30 with secondary lock pin seat 84.

Further features and details of operation of primary lock pin 28 and secondary lock pin 30 are describe in U.S. Pat. No. 8,056,519 to Cuatt et al. which is incorporated herein by reference in its entirety.

When it is desired to prevent relative rotation between rotor 18 and stator 16 at the predetermined aligned position, the pressurized oil is vented from both primary lock pin 28 and secondary lock pin 30, thereby allowing primary lock pin spring 80 and secondary lock pin spring 86 to urge primary lock pin 28 and secondary lock pin 30 respectively toward front cover 22. In order to align primary lock pin 28 and secondary lock pin 30 with primary lock pin seat 78 and secondary lock pin seat 84 respectively, rotor 18 may be rotated with respect to stator 16 by one or more of supplying pressurized oil to advance chambers 46, supplying pressurized oil to retard chambers 48, urging from bias spring 24, and torque from camshaft 14. Since primary lock pin seat 78 is enlarged, primary lock pin 28 will be seated within primary lock pin seat 78 before secondary lock pin 30 is seated within secondary lock pin seat 84. With primary lock pin 28 seated within primary lock pin seat 78, rotor 18 is allowed to rotate with respect to stator 16 by about 10°. Rotor 18 may be further rotated with respect to stator 16 by one or more of supplying pressurized oil to advance chambers 46, supplying pressurized oil to retard chambers 48, urging from bias spring 24, and torque from camshaft 14 in order to align secondary lock pin 30 with secondary lock pin seat 84, thereby allowing secondary lock pin 30 to be seated within secondary lock pin seat 84.

A lock pin oil control valve 88 may control the supply and venting of pressurized oil to and from primary lock pin 28 and secondary lock pin 30. Lock pin oil control valve 88 may be slidably disposed within a valve bore 90 of camshaft phaser attachment bolt 32 such that valve bore 90 is centered about axis A. Lock pin oil control valve 88 includes lands 92 and is axially displaced within valve bore 90 by an actuator 94 and a valve spring 96. Actuator 94 may be a solenoid actuator and may urge lock pin oil control valve 88 to a lock pin disengaged position by applying an electric current to actuator 94. Application of an electric current to actuator 94 causes lock pin oil control valve 88 to move toward the bottom of valve bore 90, thereby compressing valve spring 96 and positioning lands 92 to prevent oil from being vented from to primary lock pin 28 and secondary lock pin 30 while allowing pressurized oil to be supplied to primary lock pin 28 and secondary lock pin 30 via a primary lock pin oil passage 98 and a secondary lock pin oil passage 100 in rotor 18 from valve bore 90 which is supplied by oil source 62, for example, by a camshaft lock pin valve oil passage 102 in camshaft 14 and camshaft phaser attachment bolt 32. Conversely, valve spring 96 may urge lock pin oil control valve 88 to a lock pin engaged position when no electric current is applied to actuator 94. When no electric current is applied to actuator 94, lock pin oil control valve 88 is moved away from the bottom of valve bore 90 by valve spring 96, thereby positioning lands 92 to prevent pressurized oil from being supplied to primary lock pin 28 and secondary lock pin 30 and to vent oil from primary lock pin 28 and secondary lock pin 30. Further details of the operation of operation of lock pin oil control valve 88 and oil passages associate therewith are describe in copending U.S. patent application Ser. No. 13/667,127; now United States Patent Application Publication No. 2014/0123920 A1; to Lichti et al., the disclosure of which is incorporated herein by reference in its entirety. While lock pin oil control valve 88 has been described as being located within camshaft phaser 12, it should be understood that a valve external to camshaft phaser 12 may alternatively be used as is known in the art, for example as shown in United States Patent Application Publication No. US 2012/0255509 A1 to Lichti et al. which is incorporated herein by reference in its entirety.

With continued reference to FIGS. 1-4 and now with additional reference to FIGS. 5-8, a hydraulic circuit is provided to assist in returning rotor 18 to the predetermined aligned position in the event of failure of phasing oil control valve 60. In this way, the inherent torque reversals of camshaft 14 due to forces from the valve train of internal combustion engine 10 may be used to assist in returning rotor 18 to the predetermined aligned position. The hydraulic circuit comprises a first diverter valve 104, a second diverter valve 106, a first check valve 108, and a second check valve 110.

Figure 5:
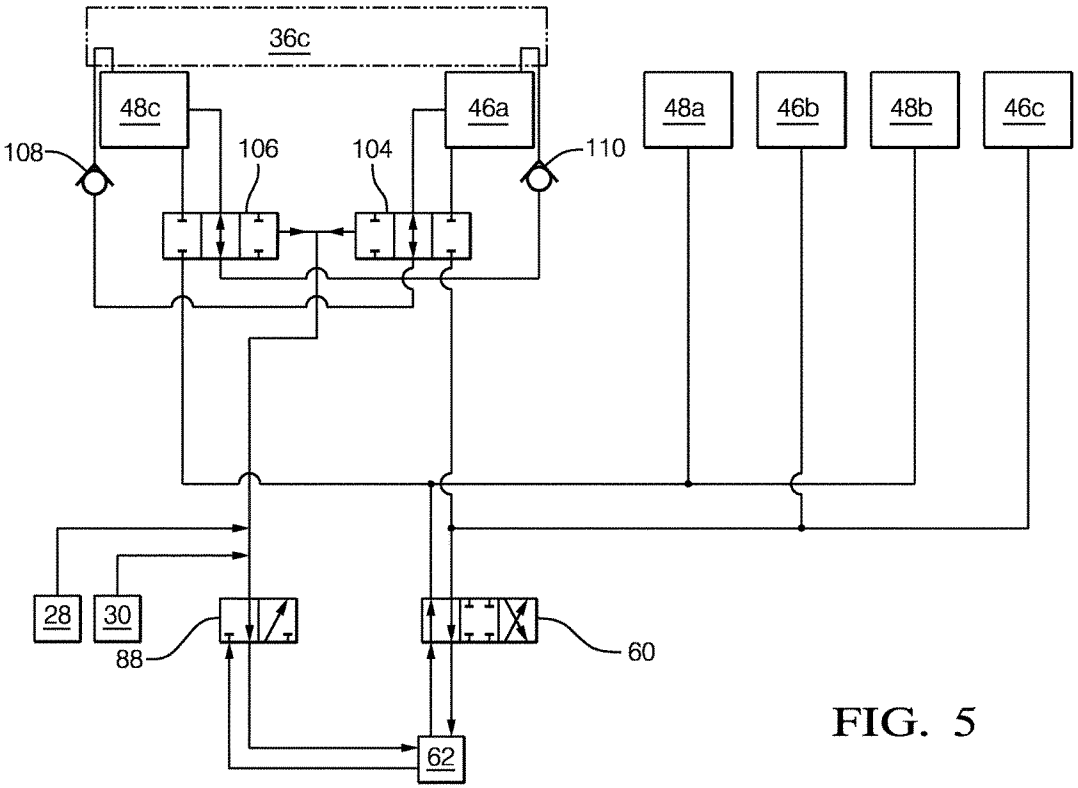
FIGS. 5-8 are hydraulic schematics of the camshaft phaser in accordance with the present invention.
Figure 6:
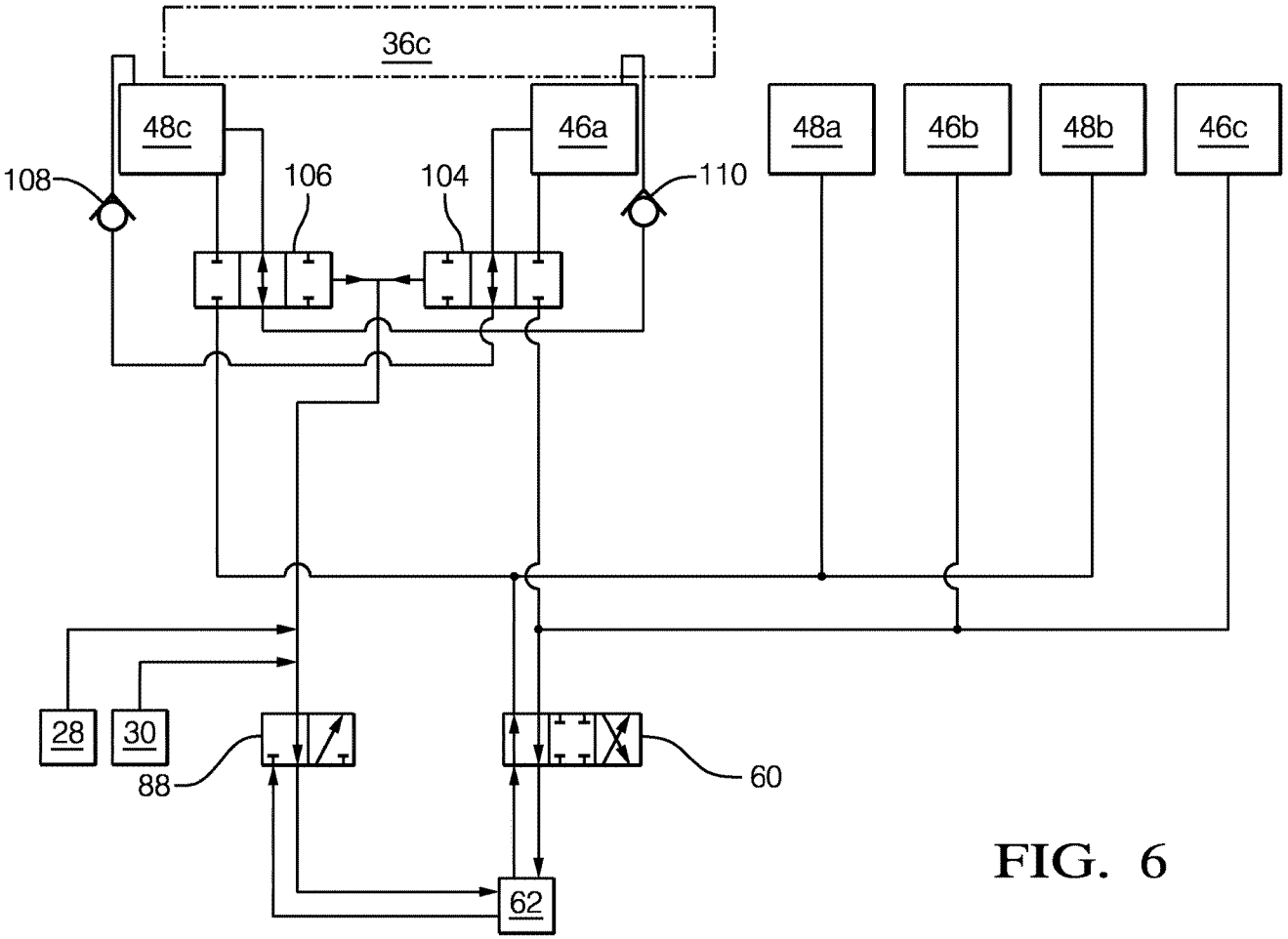
Figure 7:
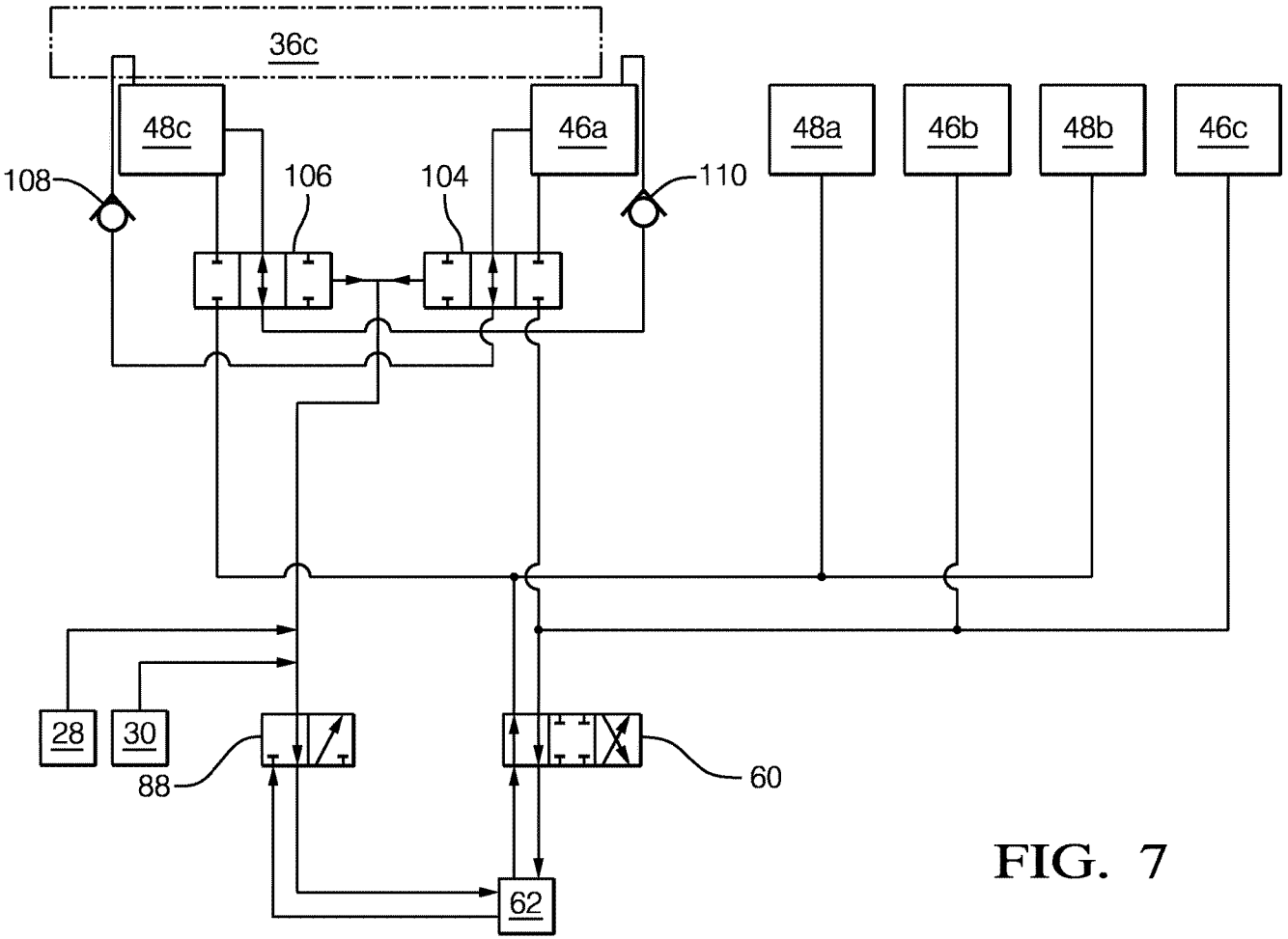
Figure 8:
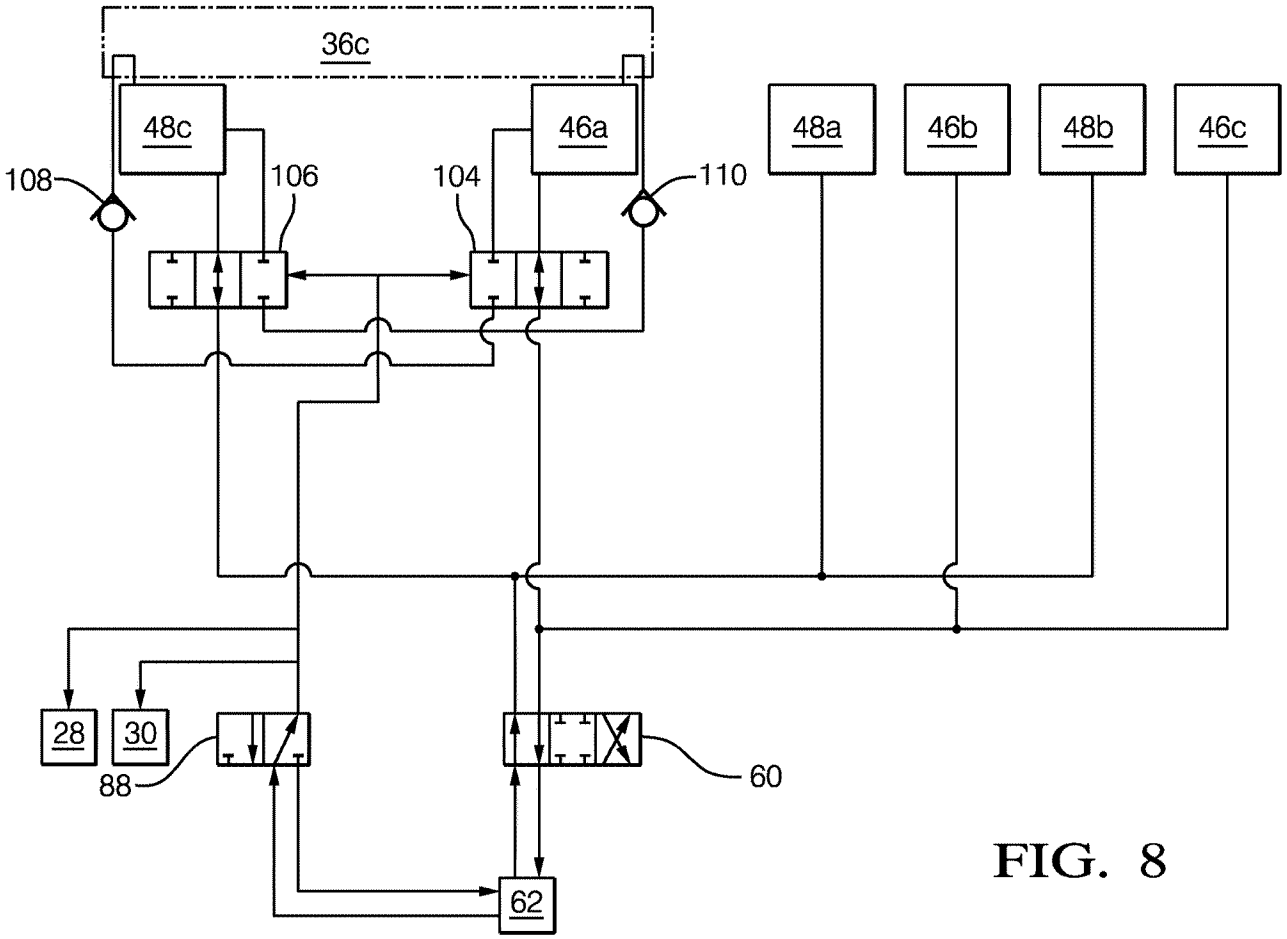

First diverter valve 104 is responsive to lock pin oil control valve 88 such that when lock pin oil control valve 88 vents oil from primary lock pin 28 and secondary lock pin 30, first diverter valve 104 is positioned to block communication between phasing oil control valve 60 and advance chamber 46*a* while permitting communication between advance chamber 46*a* and first check valve 108 as shown in FIGS. 5-7. It should be noted that communication between phasing oil control valve 60 and advance chambers 46*b*, 46*c* is maintained when first diverter valve 104 is positioned to block communication between phasing oil control valve 60 and advance chamber 46*a*. Conversely, when lock pin oil control valve 88 supplies oil to primary lock pin 28 and secondary lock pin 30, first diverter valve 104 is positioned to permit communication between phasing oil control valve 60 and advance chamber 46*a* while blocking communication between advance chamber 46*a* and first check valve 108 as shown in FIG. 8.

Second diverter valve 106 is responsive to lock pin oil control valve 88 such that when lock pin valve control valve spool 88 vents oil from primary lock pin 28 and secondary lock pin 30, second diverter valve 106 is positioned to block communication between phasing oil control valve 60 and retard chamber 48*c* while permitting communication between retard chamber 48*c* and second check valve 110 as shown in FIGS. 5-7. It should be noted that communication between phasing oil control valve 60 and retard chambers 48*a*, 48*b* is maintained when second diverter valve 106 is positioned to block communication between phasing oil control valve 60 and retard chamber 48*c*. Conversely, when lock pin oil control valve 88 supplies oil to primary lock pin 28 and secondary lock pin 30, second diverter valve 106 is positioned to permit communication between phasing oil control valve 60 and retard chamber 48*c* while blocking communication between retard chamber 48*c* and second check valve 110 as shown in FIG. 8.

First check valve 108 is in fluid communication with retard chamber 48*c* only when rotor 18 is retarded of the predetermined aligned position as shown in FIG. 6. Consequently, when first diverter valve 104 is positioned to permit communication between advance chamber 46*a* and first check valve 108, torque reversals from camshaft 14 allow oil to move from retard chamber 48*c* to advance chamber 46*a*, thereby allowing rotor 18 to advance until primary lock pin 28 seats with primary lock pin seat 78 and secondary lock pin 30 seats with secondary lock pin seat 84. It should be understood that only torque reversals of sufficient magnitude will result in oil moving from retard chamber 48*c* to advance chamber 46*a* and that oil will also be evacuated from retard chambers 48*a*, 48*b*. Also consequently, first check valve 108 is isolated or blocked from retard chamber 48*c* when rotor 18 is advanced of the predetermined aligned position as shown in FIG. 7 and is also isolated or blocked from retard chamber 48*c* when rotor 18 is in the predetermined aligned position as shown in FIG. 5, thereby preventing counterproductive movement of oil from retard chamber 48*c* to advance chamber 46*a* when there is no desire to advance rotor 18. As shown in FIGS. 5 and 7, lobe 36*c* of stator 16 may be used to isolate first check valve 108 from retard chamber 48*c* when rotor 18 is advanced of the predetermined aligned position and when rotor 18 is in the predetermined aligned position.

Similarly, second check valve 110 is in fluid communication with advance chamber 46*a* only when rotor 18 is advanced of the predetermined aligned position as shown in FIG. 7. Consequently, when second diverter valve 106 is positioned to permit communication between retard chamber 48*c* and second check valve 110, torque reversals from camshaft 14 allow oil to move from advance chamber 46*a* to retard chamber 48*c*, thereby allowing rotor 18 to retard until primary lock pin 28 seats with primary lock pin seat 78 and secondary lock pin 30 seats with secondary lock pin seat 84. It should be understood that only torque reversals of sufficient magnitude will result in oil moving from advance chamber 46*a* to retard chamber 48*c* and that oil will also be evacuated from advance chambers 46*b*, 46*c* as a result of the rotation of rotor 18. Also consequently, second check valve 110 is isolated or blocked from advance chamber 46*a* when rotor 18 is retarded of the predetermined aligned position as shown in FIG. 6 and is also isolated or blocked from advance chamber 46*a* when rotor 18 is in the predetermined aligned position as shown in FIG. 5, thereby preventing counterproductive movement of oil from advance chamber 46*a* to retard chamber 48*c* when there is no desire to retard rotor 18. As shown in FIGS. 5 and 6, lobe 36*c* of stator 16 may be used to isolate second check valve 110 from advance chamber 46*a* when rotor 18 is advanced of the predetermined aligned position and when rotor 18 is in the predetermined aligned position.

Figure 2:
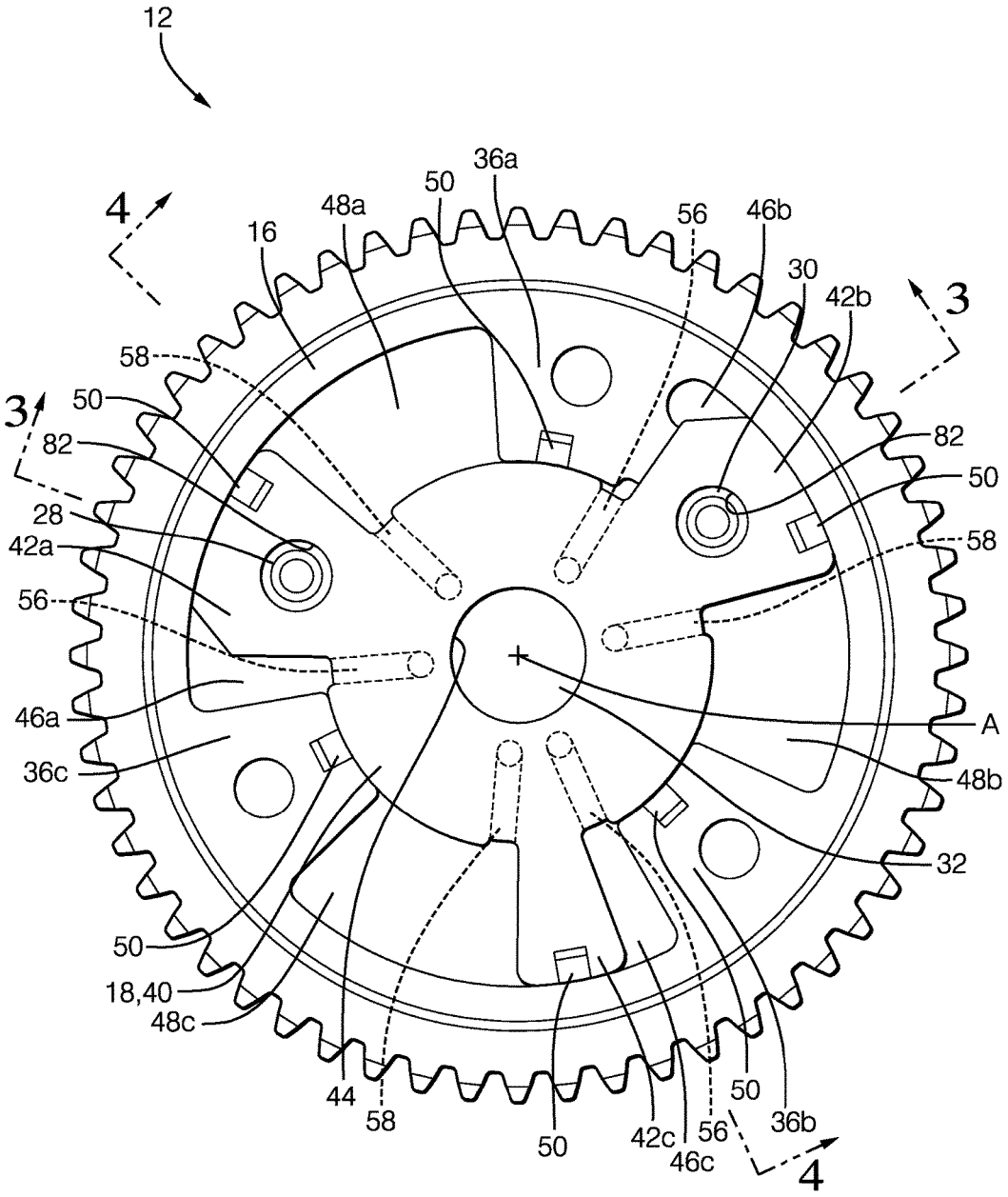
FIG. 2 is an elevation view of the camshaft phaser in accordance with the present invention with a front cover of the camshaft phaser removed.
Figure 3:
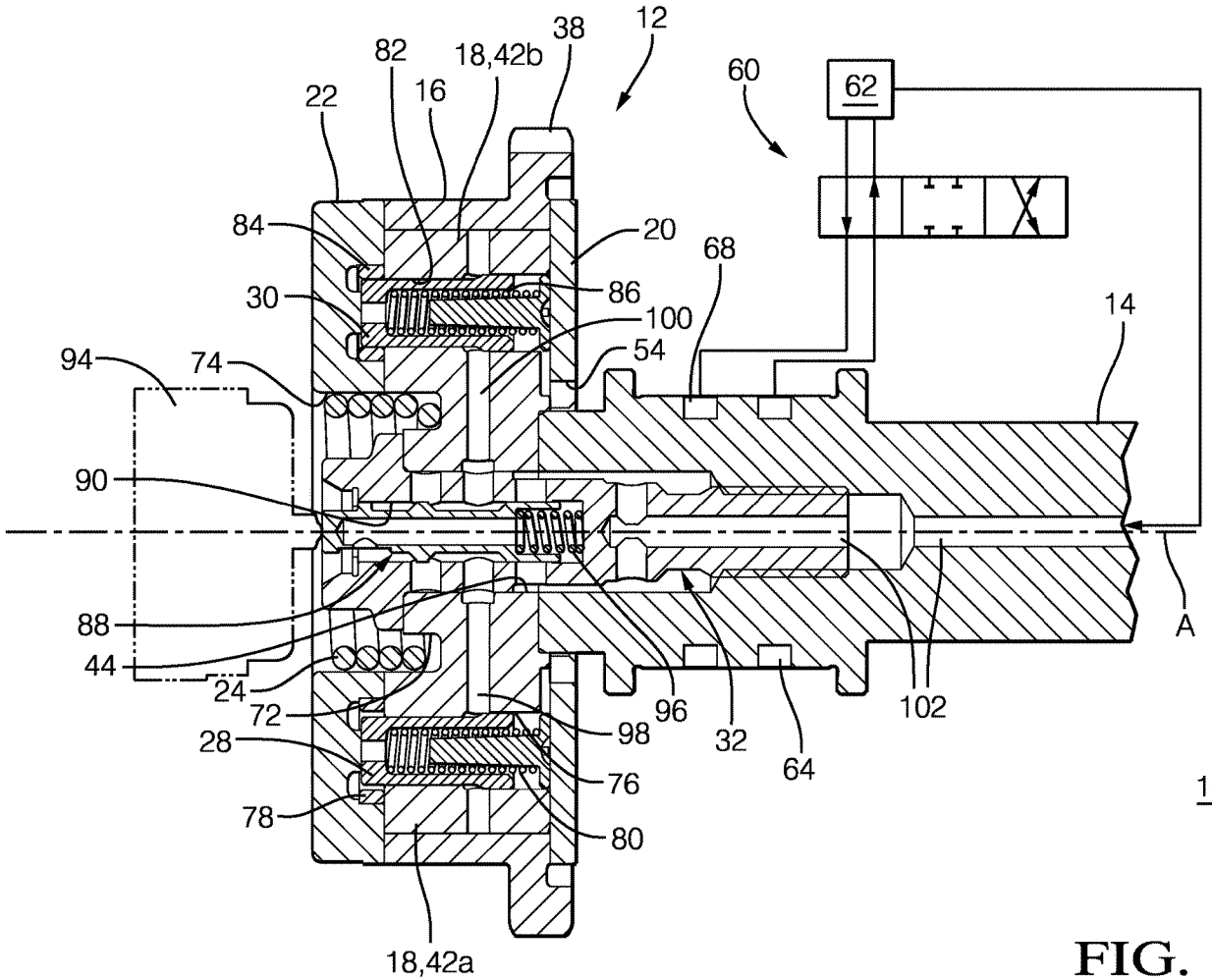
FIG. 3 is an axial cross-sectional view of the camshaft phaser in accordance with the present invention taken through section line 3-3 of FIG. 2.
Figure 4:
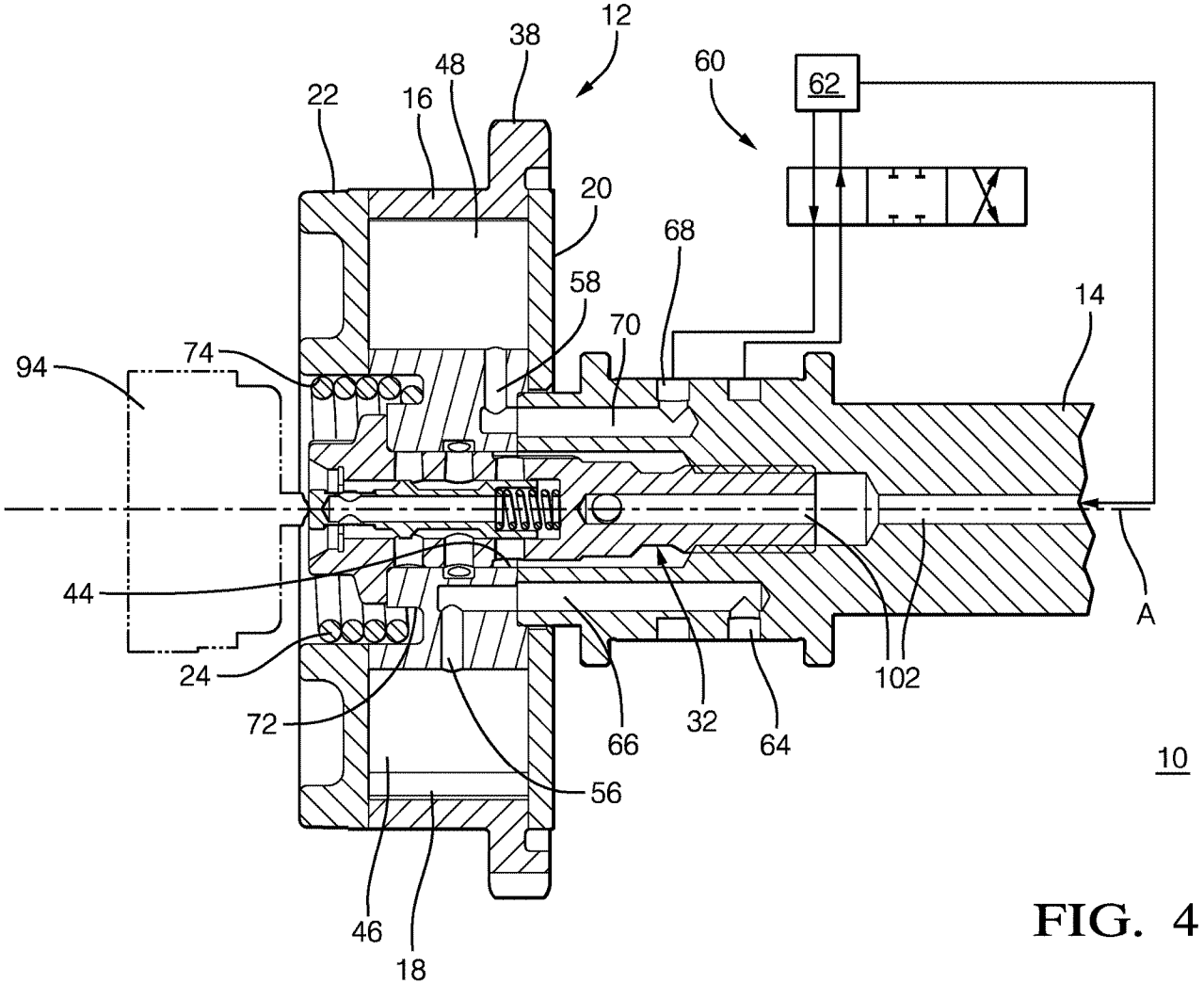
FIG. 4 is an axial cross-sectional view of the camshaft phaser in accordance with the present invention taken through section line 4-4 of FIG. 2.
Figure 9:
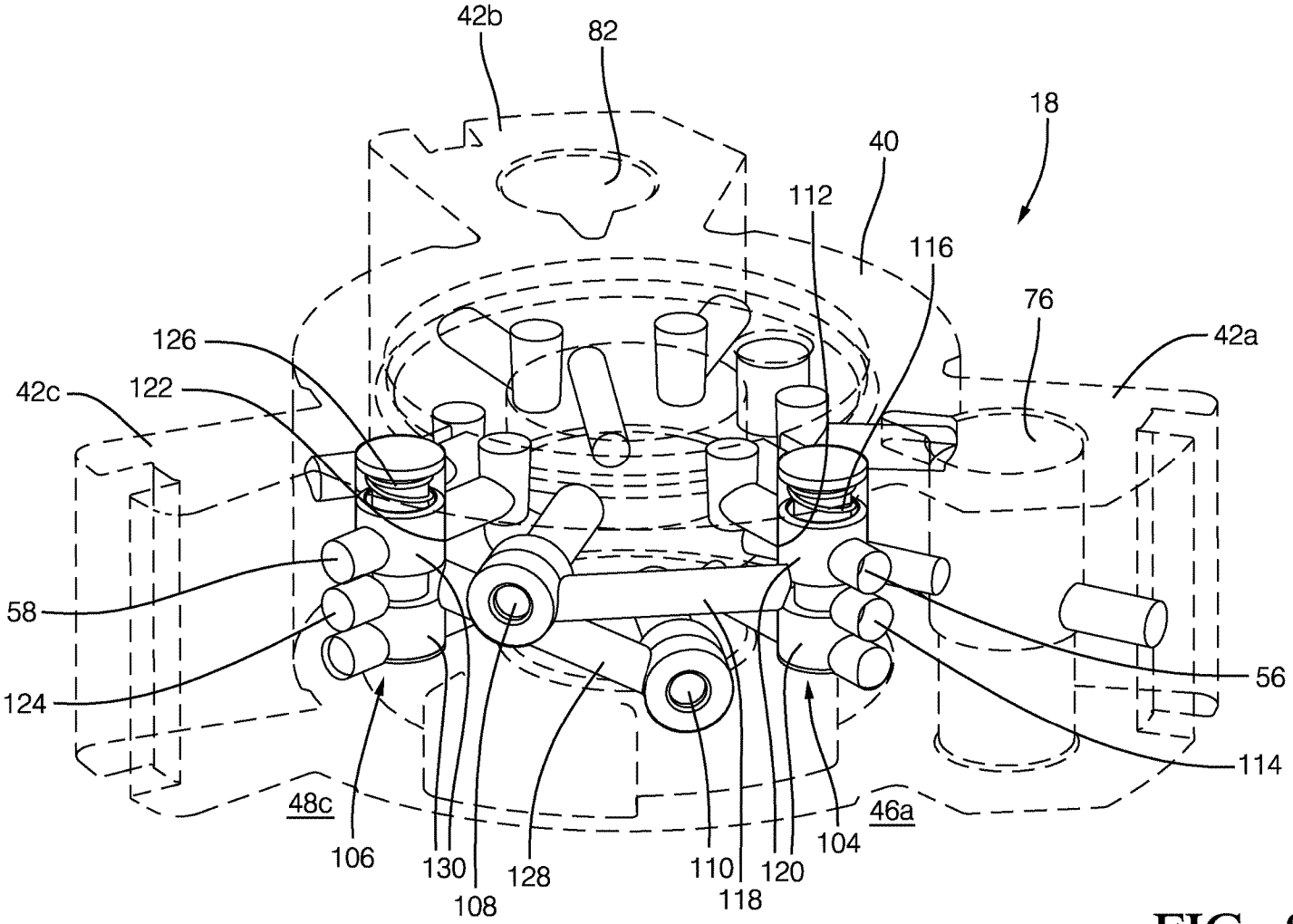
FIG. 9 is a rotor of the camshaft phaser in accordance with the present invention.

Reference will now be made to FIG. 9 which shows rotor 18 such that rotor 18 is inverted from FIGS. 1 and 2, that is, rotor 18 is viewed from the opposite face thereof. As shown in FIG. 9, first diverter valve 104, second diverter valve 106, first check valve 108, and second check valve 110 may be housed within rotor 18 as will be described further in the paragraphs that follow.

First diverter valve 104 may be slidably disposed within a first diverter valve bore 112 which extends axially into the face of rotor 18 that is proximal to camshaft 14. Advance oil passage 56 extends radially inward and radially outward from first diverter valve bore 112 while a first diverter valve bore passage 114 extends radially outward from first diverter valve bore 112 to advance chamber 46*a*. A first diverter valve spring 116 provides a biasing force to urge first diverter valve 104 downward as viewed in FIG. 9 in the absence of pressurized oil from lock pin oil control valve 88. Conversely, first diverter valve spring 116 is compressed by movement of first diverter valve 104 upward as viewed in FIG. 9 as a result of pressurized oil from lock pin oil control valve 88. A first diverter valve connecting passage 118 connects first diverter valve bore 112 to first check valve 108 which is mounted in central hub 40 of rotor 18. First diverter valve 104 includes first diverter valve lands 120 which function to block communication between advance chamber 46*a* and phasing oil control valve 60 in the absence of pressurized oil from lock pin oil control valve 88 being applied to first diverter valve 104 while allowing communication between advance chamber 46*a* and first check valve 108. First diverter valve lands 120 also function to block communication between advance chamber 46*a* and first check valve 108 when pressurized oil from lock pin oil control valve 88 is applied to the axial end of first diverter valve 104 that is opposite of first diverter valve spring 116 while allowing communication between advance chamber 46*a* and phasing oil control valve 60.

Second diverter valve 106 may be slidably disposed within a second diverter valve bore 122 which extends axially into the face of rotor 18 that is proximal to camshaft 14. Retard oil passage 58 extends radially inward and radially outward from second diverter valve bore 122 while a second diverter valve bore passage 124 extends radially outward from second diverter valve bore 122 to retard chamber 48*c*. A second diverter valve spring 126 provides a biasing force to urge second diverter valve 106 downward as viewed in FIG. 9 in the absence of pressurized oil from lock pin oil control valve 88. Conversely, second diverter valve spring 126 is compressed by movement of second diverter valve 106 upward as viewed in FIG. 9 as a result of pressurized oil from lock pin oil control valve 88. A second diverter valve connecting passage 128 connects second diverter valve bore 122 to second check valve 110 which is mounted in central hub 40 of rotor 18. Second diverter valve 106 includes second diverter valve lands 130 which function to block communication between retard chamber 48*c* and phasing oil control valve 60 in the absence of pressurized oil from lock pin oil control valve 88 being applied to second diverter valve 106 while allowing communication between retard chamber 48*c* and second check valve 110. Second diverter valve lands 130 also function to block communication between retard chamber 48*c* and second check valve 110 when pressurized oil from lock pin oil control valve 88 is applied to the axial end of second diverter valve 106 that is opposite of second diverter valve spring 126 while allowing communication between retard chamber 48*c* and phasing oil control valve 60.

The hydraulic circuit described in the preceding paragraphs provides an improved fail-safe engagement of primary lock pin 28 and secondary lock pin 30 with primary lock pin seat 78 and secondary lock pin seat 84 respectively without the need to redesign phasing oil control valve 60 or other aspects of internal combustion engine 10.

Figure 10:
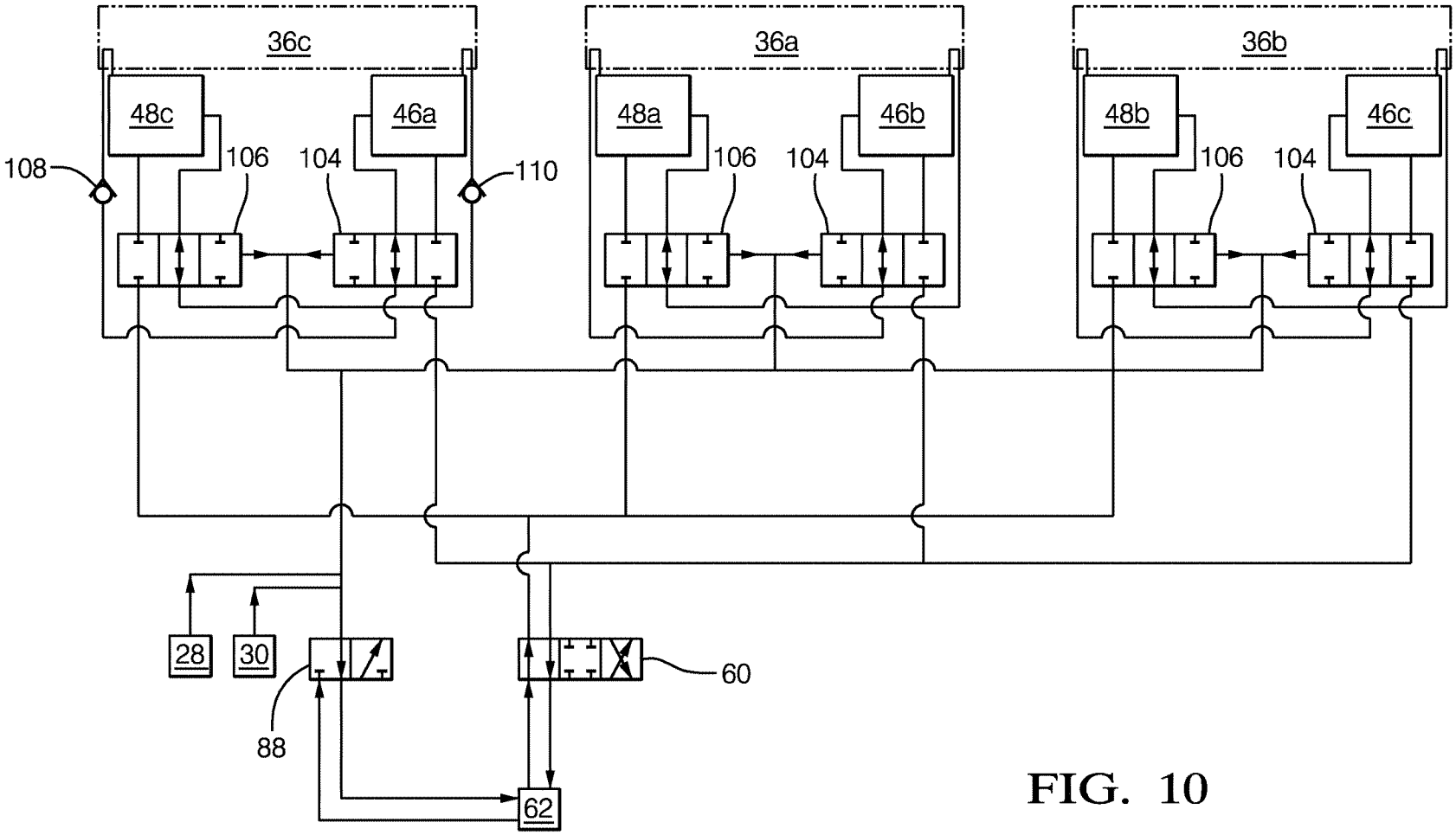
FIG. 10 is an alternative of FIG. 5.

In an alternative arrangement as shown in FIG. 10, the hydraulic circuit used to assist in returning rotor 18 to the predetermined aligned position has been expanded to include first diverter valve 104 and second diverter valve 106 corresponding to advance chamber 46*b* and retard chamber 48*a* respectively and also to include first diverter valve 104 and second diverter valve 106 corresponding to advance chamber 46*c* and retard chamber 48*b* respectively. Consequently, corresponding passages are provided in rotor 18 to permit operation of the additional first diverter valves 104 and second diverter valves 106 as described previously relative to first diverter valve 104 and second diverter valve 106 which correspond to advance chamber 46*a* and retard chamber 48*c* respectively. Including first diverter valve 104 and second diverter valve 106 corresponding to advance chamber 46*b* and retard chamber 48*a* respectively and including first diverter valve 104 and second diverter valve 106 corresponding to advance chamber 46*c* and retard chamber 48*b* respectively may provide a more robust arrangement for assisting in returning rotor 18 to the predetermined aligned position. The Inventors have discovered that only one first check valve 108 and only one second check valve 110 may be needed as shown in FIG. 10, however, additional first check valves 108 and additional second check valves 110 may be included corresponding to retard chambers 48*a*, 48*b* and advance chambers 46*b*, 46*c* respectively. While additional first check valves 108 and additional second check valves 110 may increase efficiency, the increase in efficiency may be minimal and may not justify the added cost and complexity. It should be noted that when only one first check valve 108 and only one second check valve 110 are included as shown in FIG. 10, passages still exist to connect advance chamber 46*b* to retard chamber 48*a* through first diverter valve 104 and second diverter valve 106 and to connect advance chamber 46*c* to retard chamber 48*b* through first diverter valve 104 and second diverter valve 106.

Figure 11:
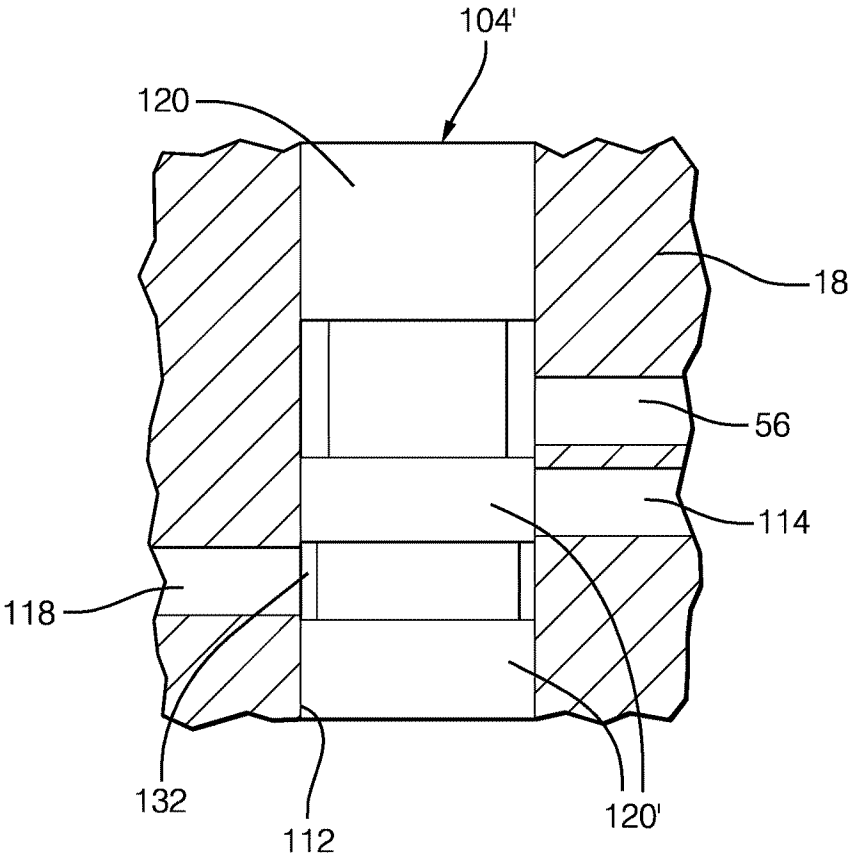

When first diverter valve 104 is positioned to block communication between advance chamber 46*a* and first check valve 108 while allowing communication between advance chamber 46*a* and phasing oil control valve 60, pressurized oil from first diverter valve connecting passage 118 may apply a side load to first diverter valve land 120 that is at the bottom of first diverter valve 104 as oriented in FIG. 9 which may delay movement of first diverter valve 104 by first diverter valve spring 116 when first diverter valve 104 needs to be positioned by first diverter valve spring 116 to block communication between advance chamber 46*a* and phasing oil control valve 60 while allowing communication between advance chamber 46*a* and first check valve 108. In order to remedy this condition, a first diverter valve 104' as shown in FIG. 11 may be substituted for first diverter valve 104. First diverter valve 104' includes first diverter valve land 120 which blocks communication between advance chamber 46*a* and phasing oil control valve 60 in the absence of pressurized oil from lock pin oil control valve 88 being applied to first diverter valve 104' (first diverter valve spring 116 positions first diverter valve 104'). First diverter valve 104' also includes first diverter valve land 120' which blocks communication between advance chamber 46*a* and first check valve 108 when pressurized oil from lock pin oil control valve 88 is applied to first diverter valve 104', thereby compressing first diverter valve spring 116. First diverter valve land 120' includes a first diverter valve land groove 132 which extends circumferentially around first diverter valve land 120' and which is aligned with first diverter valve connecting passage 118 as shown in FIG. 11. Consequently, pressurized oil from first diverter valve connecting passage 118 acts circumferentially on first diverter valve 104' when pressurized oil from lock pin oil control valve 88 is applied to first diverter valve 104', thereby minimizing side load on first diverter valve 104'.

Figure 12:
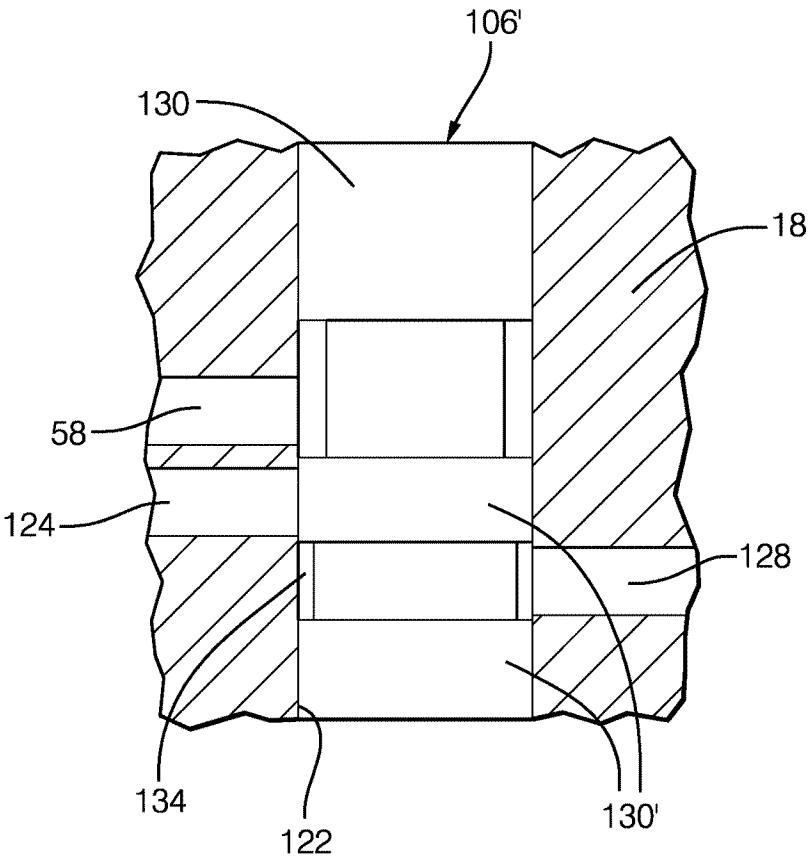
FIGS. 11 and 12 are diverter valves of the camshaft phaser in accordance with the present invention.

Similarly, when second diverter valve 106 is positioned to block communication between retard chamber 48*c* and second check valve 110 while allowing communication between retard chamber 48*c* and phasing oil control valve 60, pressurized oil from second diverter valve connecting passage 128 may apply a side load to second diverter valve land 130 that is at the bottom of second diverter valve 106 as oriented in FIG. 9 which may delay movement of second diverter valve 106 by second diverter valve spring 126 when second diverter valve 106 needs to be positioned by second diverter valve spring 126 to block communication between retard chamber 48*c* and phasing oil control valve 60 while allowing communication between retard chamber 48*c* and second check valve 110. In order to remedy this condition, a second diverter valve 106' as shown in FIG. 12 may be substituted for second diverter valve 106. Second diverter valve 106' includes second diverter valve land 130 which blocks communication between retard chamber 48*c* and phasing oil control valve 60 in the absence of pressurized oil from lock pin oil control valve 88 being applied to second diverter valve 106' (second diverter valve spring 126 positions second diverter valve 106'). Second diverter valve 106' also includes second diverter valve land 130' which blocks communication between retard chamber 48*c* and second check valve 110 when pressurized oil from lock pin oil control valve 88 is applied to second diverter valve 106', thereby compressing second diverter valve spring 126. Second diverter valve land 130' includes a second diverter valve land groove 134 which extends circumferentially around second diverter valve land 130' and which is aligned with second diverter valve connecting passage 128 as shown in FIG. 12. Consequently, pressurized oil from second diverter valve connecting passage 128 acts circumferentially on second diverter valve 106' when pressurized oil from lock pin oil control valve 88 is applied to second diverter valve 106', thereby minimizing side load on second diverter valve 106'.

While this invention has been described in terms of preferred embodiments thereof, it is not intended to be so limited.

We claim:

1. A camshaft phaser for use with an internal combustion engine for controllably varying the phase relationship between a crankshaft and a camshaft in said internal combustion engine, said camshaft phaser comprising:

a stator having a plurality of lobes and connectable to said crankshaft of said internal combustion engine to provide a fixed ratio of rotation between said stator and said crankshaft;

a rotor coaxially disposed within said stator, said rotor having a plurality of vanes interspersed with said lobes defining a plurality of alternating advance chambers and retard chambers, wherein said advance chambers receive pressurized oil from a phasing oil control valve in order to change the phase relationship between said crankshaft and said camshaft in an advance direction and said retard chambers receive pressurized oil from said phasing oil control valve in order to change the phase relationship between said camshaft and said crankshaft in a retard direction, said rotor being rotatable within said stator from a full retard position to a full advance position and being attachable to said camshaft of said internal combustion engine to prevent relative rotation between said rotor and said camshaft;

a lock pin disposed within one of said rotor and said stator for selective engagement with a lock pin seat for preventing a change in phase relationship between said rotor and said stator at a predetermined aligned position between said full advance position and said full retard position when said lock pin is engaged with said lock pin seat;

a first diverter valve that is switchable between two positions of 1) blocking communication between said phasing oil control valve and only one of said advance chambers while permitting communication between said one of said advance chambers and a first check valve and of 2) permitting communication between said phasing oil control valve and said one of said advance chambers while blocking communication between said one of said advance chambers and said first check valve; and a second diverter valve that is switchable between two positions of 1) blocking communication between said phasing oil control valve and only one of said retard chambers while permitting communication between said one of said retard chambers and a second check valve and of 2) permitting communication between said phasing oil control valve and said one of said retard chambers while blocking communication between said one of said retard chambers and said second check valve;

wherein said first check valve allows oil to flow from said one of said retard chambers to said one of said advance chambers for at least some positions of said rotor relative to said stator when said first diverter valve permits communication between said one of said advance chambers and said first check valve; and wherein said second check valve allows oil to flow from said one of said advance chambers to said one of said retard chambers for at least some positions of said rotor relative to said stator when said second diverter valve permits communication between said one of said retard chambers and said second check valve.

2. The camshaft phaser as in claim 1 wherein:

said lock pin receives pressurized oil from a lock pin oil control valve in order prevent said lock pin from engaging said lock pin seat and oil is vented from said lock pin by said lock pin oil control valve in order to allow said lock pin to engage said lock pin seat;

said first diverter valve is responsive to said lock pin oil control valve such that 1) said first diverter valve blocks communication between said phasing oil control valve and only one of said advance chambers while permitting communication between said one of said advance chambers and said first check valve when said lock pin oil control valve vents oil from said lock pin and 2) said first diverter valve permits communication between said phasing oil control valve and said one of said advance chambers and blocks communication between said one of said advance chambers and said first check valve when said lock pin oil control valve supplies pressurized oil to said lock pin; and said second diverter valve is responsive to said lock pin oil control valve such that 1) said second diverter valve blocks communication between said phasing oil control valve and only one of said retard chambers and permits communication between said one of said retard chambers and said second check valve when said lock pin oil control valve vents oil from said lock pin and 2) said second diverter valve permits communication between said phasing oil control valve and said one of said retard chambers and blocks communication between said one of said retard chambers and said second check valve when said lock pin oil control valve supplies pressurized oil to said lock pin.

3. The camshaft phaser as in claim 2 wherein:

said first check valve is in fluid communication with said one of said retard chambers only when said rotor is retarded of said predetermined aligned position, thereby allowing torque reversals from said camshaft to advance said rotor by allowing oil to flow from said one of said retard chambers to said one of said advance chambers when said rotor is retarded of said predetermined aligned position and said lock pin oil control valve vents oil from said lock pin; and said second check valve is in fluid communication with said one of said advance chambers only when said rotor is advanced of said predetermined aligned position, thereby allowing torque reversals from said camshaft to retard said rotor by allowing oil to flow from said one of said advance chambers to said one of said retard chambers when said rotor is advanced of said predetermined aligned position and said lock pin oil control valve vents oil from said lock pin.

4. The camshaft phaser as in claim 3 wherein:

one of said plurality of lobes blocks fluid communication between said first check valve and said one of said retard chambers when said rotor is in said predetermined aligned position and when said rotor is advanced of said predetermined aligned position; and said one of said plurality of lobes blocks fluid communication between said second check valve and said one of said advance chambers when said rotor is in said predetermined aligned position and when said rotor is retarded of said predetermined aligned position.

5. The camshaft phaser as in claim 3 wherein:

said first diverter valve is slidably disposed within a first diverter valve bore defined by said rotor; and said second diverter valve is slidably disposed within a second diverter valve bore defined by said rotor.

6. The camshaft phaser as in claim 5 wherein:

an advance oil passage extends through said rotor from said first diverter valve bore to said one of said advance chambers;

a first diverter valve bore passage extends through said rotor from said first diverter valve bore to said one of said advance chambers;

a first diverter valve connecting passage extends through said rotor from said first check valve to said first diverter valve bore;

a retard oil passage extends through said rotor from said second diverter valve bore to said one of said retard chambers;

a second diverter valve bore passage extends through said rotor from said second diverter valve bore to said one of said retard chambers;

a second diverter valve connecting passage extends through said rotor from said second check valve to said second diverter valve bore.

7. The camshaft phaser as in claim 6 wherein:

said first diverter valve includes a plurality of first diverter valve lands such that one of said plurality of first diverter valve lands includes a first diverter valve land groove that circumferentially surrounds said one of said plurality of first diverter valve lands such that said first diverter valve land groove is aligned with said first diverter valve connecting passage when said first diverter valve is switched to permit communication between said phasing oil control valve and said one of said advance chambers while blocking communication between said one of said advance chambers and said first check valve, said first diverter valve land groove permitting pressurized oil from said first diverter valve connecting passage to act circumferentially on said first diverter valve; and said second diverter valve includes a plurality of second diverter valve lands such that one of said plurality of second diverter valve lands includes a second diverter valve land groove that circumferentially surrounds said one of said plurality of second diverter valve lands such that said second diverter valve land groove is aligned with said second diverter valve connecting passage when said second diverter valve is switched to permit communication between said phasing oil control valve and said one of said retard chambers while blocking communication between said one of said retard chambers and said second check valve, said second diverter valve land groove permitting pressurized oil from said second diverter valve connecting passage to act circumferentially on said second diverter valve.

8. The camshaft phaser as in claim 5 wherein:

said first diverter valve includes a first diverter valve spring which biases said first diverter valve in said first diverter valve bore toward a position which blocks communication between said phasing oil control valve and said one of said advance chambers while permitting communication between said one of said advance chambers and said first check valve; and said second diverter valve includes a second diverter valve spring which biases said second diverter valve in said second diverter valve bore toward a position which blocks communication between said phasing oil control valve and said one of said retard chambers while permitting communication between said one of said retard chambers and said second check valve.

9. The camshaft phaser as in claim 8 wherein:

said first diverter valve compresses said first diverter valve spring when said first diverter valve is switched to permit communication between said phasing oil control valve and said one of said advance chambers while blocking communication between said one of said advance chambers and said first check valve; and said second diverter valve compresses said second diverter valve spring when said second diverter valve is switched to permit communication between said phasing oil control valve and said one of said retard chambers while blocking communication between said one of said retard chambers and said second check valve.

10. The camshaft phaser as in claim 5 wherein said first check valve and said second check valve are disposed within said rotor.

11. The camshaft phaser as in claim 1 wherein:

said first diverter valve is slidably disposed within a first diverter valve bore defined by said rotor; and said second diverter valve is slidably disposed within a second diverter valve bore defined by said rotor.

12. The camshaft phaser as in claim 11 wherein:

an advance oil passage extends through said rotor from said first diverter valve bore to said one of said advance chambers;

a first diverter valve bore passage extends through said rotor from said first diverter valve bore to said one of said advance chambers;

a first diverter valve connecting passage extends through said rotor from said first check valve to said first diverter valve bore;

a retard oil passage extends through said rotor from said second diverter valve bore to said one of said retard chambers;

a second diverter valve bore passage extends through said rotor from said second diverter valve bore to said one of said retard chambers;

a second diverter valve connecting passage extends through said rotor from said second check valve to said second diverter valve bore.

13. The camshaft phaser as in claim 12 wherein:

said first diverter valve includes a plurality of first diverter valve lands such that one of said plurality of first diverter valve lands includes a first diverter valve land groove that circumferentially surrounds said one of said plurality of first diverter valve lands and that is aligned with said first diverter valve connecting passage when said first diverter valve is switched to permit communication between said phasing oil control valve and said one of said advance chambers while blocking communication between said one of said advance chambers and said first check valve, said first diverter valve land groove permitting pressurized oil from said first diverter valve connecting passage to act circumferentially on said first diverter valve; and said second diverter valve includes a plurality of second diverter valve lands such that one of said plurality of second diverter valve lands includes a second diverter valve land groove that circumferentially surrounds said one of said plurality of second diverter valve lands and that is aligned with said second diverter valve connecting passage when said second diverter valve is switched to permit communication between said phasing oil control valve and said one of said retard chambers while blocking communication between said one of said retard chambers and said second check valve, said second diverter valve land groove permitting pressurized oil from said second diverter valve connecting passage to act circumferentially on said second diverter valve.

14. The camshaft phaser as in claim 11 wherein said first check valve and said second check valve are disposed within said rotor.

15. The camshaft phaser as in claim 1 wherein:

said first diverter valve is one of a plurality of first diverter valves such that each of said plurality of first diverter valves is associated with a respective one of said advance chambers and with a respective one of said retard chambers; and said second diverter valve is one of a plurality of second diverter valves such that each of said plurality of second diverter valves is associated with a respective one of said advance chambers and with a respective one of said retard chambers.

16. The camshaft phaser as in claim 15 wherein:

said first check valve is associated with only one of said plurality of first diverter valves; and said second check valve is associated with only one of said plurality of second diverter valves.

17. The camshaft phaser as in claim 16 wherein:

each of said plurality of first diverter valves except said one of said plurality of first diverter valves do not have a respective said first check valve associated therewith; and each of said plurality of second diverter valves except said one of said plurality of second diverter valves do not have a respective said second check valve associated therewith.

* * * * *